United States Patent [19]

Rizzardi

[11] Patent Number: 4,773,551

[45] Date of Patent: Sep. 27, 1988

[54] CLOSURE FOR A BOTTLE OR THE LIKE EQUIPPED WITH A DROPPER

[75] Inventor: Napoleone Rizzardi, Milan, Italy

[73] Assignee: Capsulit S.p.A., Milan, Italy

[21] Appl. No.: 73,693

[22] Filed: Jul. 8, 1987

[30] Foreign Application Priority Data

Jul. 31, 1986 [IT] Italy ..... 22698/86[U]

[51] Int. Cl.[4] ..... B65D 47/18

[52] U.S. Cl. ..... 215/253; 215/274; 222/420; 222/567

[58] Field of Search ..... 222/420, 421, 566, 567; 215/228, 252, 253, 274

[56] References Cited

U.S. PATENT DOCUMENTS 4,200,100 4/1980 Willis ..... 222/541 X 4,498,609 2/1985 Stock ..... 222/567 X

FOREIGN PATENT DOCUMENTS 2906818 11/1979 Fed. Rep. of Germany ..... 222/546

*Primary Examiner*—Stephen Marcus

*Assistant Examiner*—Nova Stucker

*Attorney, Agent, or Firm*—Michael J. Striker

[57] ABSTRACT

A safety closure for a bottle or the like equipped with a dropper, comprising a dropper (4) having near its base an annular projection (5) bearing on the edge of the mouth of the bottle (1), a cap (9) enclosing the dropper and having at its base a collar (11) which lies over said annular projection (5) of dropper (4) and is pressed down onto this latter by the flat top part (14) of a safety strap (13) rolled around the neck (2) of the bottle, wherein said cap (9) and said collar (11) have means (17–19) for engagement of these two elements with one another, which means (17–19) ensure that the cap is kept in place after a first utilization, the collar (11) further having means for engagement with said saftey strap (13).

12 Claims, 1 Drawing Sheet

CLOSURE FOR A BOTTLE OR THE LIKE EQUIPPED WITH A DROPPER

This invention relates to a safety closure for a bottle or the like equipped with a dropper means.

Closures for bottles equipped with droppers are already known. They comprise a large number of parts and problems arise when fitting such a type of closure to a bottle due to difficulties encountered in keeping the whole assembly together under the load vibration conditions created during manufacture.

An object of the invention is to provide a closure for a bottle equipped with a dropper, which closure has a very few number of parts making up a single unit that can be easily fitted to a bottle without incurring the risk of any component thereof getting loose during manufacture.

An other object of the invention is to ensure that the mouthpiece covering the dropper is firmly retained in place subsequent to a first utilization of the concerned bottle, so as to prevent said mouthpiece from coming inadvertently loose as a result of accidental blows being exerted thereon.

The closure for a bottle equipped with dropper according to the invention is of a type including a covering cap for the dropper, this covering cap having at its base an annular collar arranged to lie over the bottle mouth and held in place by an aluminium strap which is rolled around the bottle neck and which is detachable from said collar by causing joining zones therebetween to be broken away, the closure being characterized in that means are provided on both the collar and the cap for engagement of these two elements with one another so that the cap can be held locked in place after a first utilization, and in that further means are provided on said collar for the whole assembly being held together during manufacture.

Said means for engagement of the collar and the cap with one another are in the form of respective projections perimetrally extending from said elements so as to define a bayonet joint therebetween.

The means formed on the collar in order to have the whole assembly held together during manufacture, is a turned-over edge of the collar which will lie over the top face of said strap, which latter is rolled around the bottle neck thereby to prevent it from getting detached.

The above and other features of the closure according to the invention for a bottle or the like equipped with dropper means, will be better understood from the following detailed description when read in connection with the accompanying drawing which shows, by way of a non restrictive example, a preferred embodiment of the invention. In the drawing.

Figure 1:
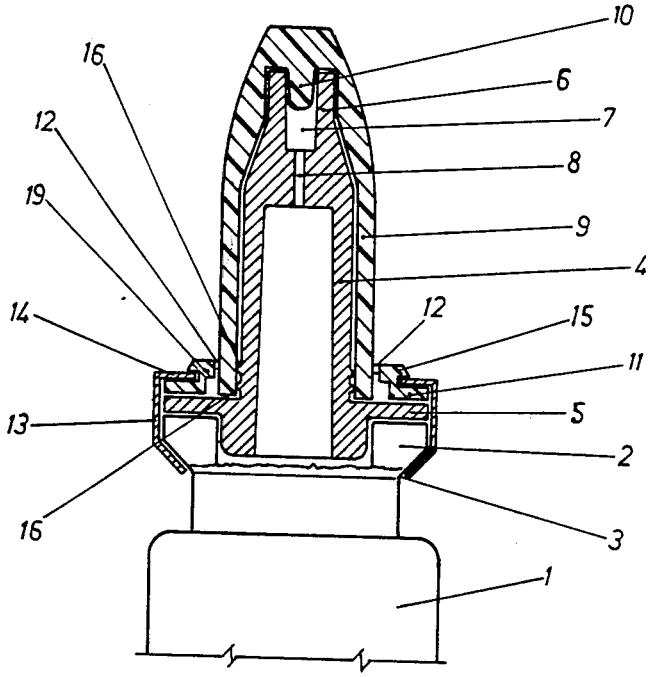
FIG. 1 is a middle cross-sectional view of a closure according to the invention as fitted to a bottle.

With reference to the above figures, there is designated by 1 a bottle for a liquid substance to be delivered by drops, particularly a pharmaceutical preparation, the bottle 1 having a neck 2 with a shoulder 3 at its bottom.

Fitted on the bottle is a rubber dropper 4 of elongated tubular shape which extends down into the bottle neck over a short distance and which has an annular projection 5 bearing on the edge of the bottle mouth.

At its top, the dropper has a mouthpiece 6 having a cavity 7 that communicates with the inner cavity of the dropper and, thus, of the bottle 1, via a substantially capillary passage 8 which prevents any liquid from being delivered or dropped unintentionally, thereby to permit control of the drop-delivered liquid as a result of a squeeze imparted on the side of the dropper.

The dropper 4 is enclosed by a covering cap 9 the inner wall of which conforms to the outer shape of the dropper.

The covering cap 9 has on its bottom a stake 10 fitting into the cavity 7 in a sealing manner, and is provided at a lower part thereof with an annular collar 11 joining through breaking zonees 12 with the covering cap.

The collar 11 extends over the annular projection 5 of the dropper and is held pressed down against said projection by the upper flat annular portion 14 of a safety metal strap 13 preferably of aluminium, which is firmly secured in place on the underside of the bottle neck 2 as by being rolled against the neck shoulder 3.

According to an important feature of the invention, the collar 11 has at its top an overturned annular edge 15 which overlaps the flat portion 14 of the strap 13 in order to hold the whole assembly together during manufacture thereby to prevent the different components from being displaced, or even getting loose with respect to each other.

It is to be noted that the holding-together of the cap 9 and dropper 4 during manufacture operations can be ensured, inter alia, by means of jutting-out annular formations 16 provided adjacent the base of the dropper 4, which are also helpful in keeping the cap and the dropper engaged with one another after a first utilization has taken place.

Figure 2:
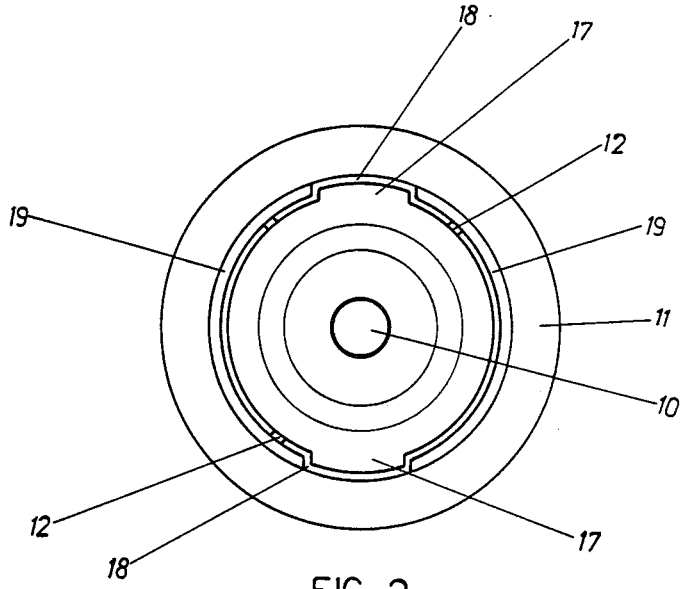
FIG. 2 is a bottom plan view showing the covering cap and the associated collar.

According to another important feature of the invention, formed on the lower edge of the cap 9 are perimetrally extending projections 17, in number of two in the embodiment shown in FIG. 2, which projections, in an assembled condition of the bottle, are received in corresponding recesses 18 formed in an annular inner projection 19 on the upper edge of the collar 11.

With the above construction, the cap 9 can be detached, for a first use, by breaking off the joining zones 12 as, for example, by applying a sideways directed force thereto, after which the cap can be put again, and firmly retained in place, subsequent to each further utilization, by causing said projections 17 to fit into the corresponding recesses 18 and then imparting a slight turn on the cap so as to have same projections 17 firmly retained under the annular projection 19 on collar 11 substantially by a sort of bayonet joint.

In this way, the holding-together of the cap and the dropper can be ensured, after a first utilization, even in case of accidental forces being exerted upon the cap.

It is preferred that the cap 9 and collar 11 are made from a plastic material which is rigid or semi-rigid in character and this both in order that the dropper 4 can effectively withstand any squeezing force that could be applied thereto unintentionally, and that an enhanced holding-together power is achieved between the cap and the dropper through the action of the above described bayonet joint.

Though a preferred embodiment of a closure according to the invention, for a bottle or the like equipped with a dropper, has been described herein above and shown by the accompanying drawing, it is intended that many changes as to the details of construction may be made thereto without departing from the spirit and scope of the invention.

I claim:

1. A safety closure for a bottle or the like equipped with a dropper, comprising:

a dropper (4) having a lower portion with an annular projection for bearing on an edge of a mouth of a bottle (1);

a cap (9) enclosing said dropper and having a base with a collar (11) extending over said annular projection (5) of the dropper (4); and means for keeping said collar (11) pressed down on said annular projection (5) and including an upper flat portion (14) of a safety strap (13) on said collar, said safety strap extending from said upper flat portion (14) so as to be rollable around a neck (2) of the bottle (1), both said cap (9) and said collar (11) having first engaging means (17–19) provided thereon for engagement with each other so that that said cap can be kept in place after a first utilization, said collar further including second engaging means for engagement with said safety strap (13).

2. The closure according to claim 1, wherein said first engaging means have projections (17) perimetrally extending from a lower part of the cap (9) and fitting as is in a bayonet joint below an annular inner projection (19) on the collar (11) after having been received in associated recesses (18) formed in said projection (19).

3. The closure according to claim 1, wherein said second engaging means includes an upper over-turned edge extending from said collar (11) and overlapping said flat top portion (14) of said strap (13).

4. The closure according to claim 1, wherein the cap (9) and the collar (11) are integrally connected with one another by joining zones (12) which are broken off at the time when a first utilization is effected.

5. The closure according to claim 1, wherein annular raised zones (16) are provided near the base of the dropper (4) and are such as to interfere with the inner surface of the cap (9).

6. The closure according to claim 1, wherein a stake (10) is provided on the bottom of the cap (9) and is arranged to fit into a cavity (7) at the upper end of the dropper (4) so as to provide a tight seal therein.

7. The closure according to claim 2, wherein said second engaging means includes an upper over-turned edge extending from said collar (11) and overlapping said flat top portion (14) of said strap (13).

8. The closure as defined in claim 1, wherein said cap (9) and said collar (11) are composed of plastic material so that said dropper (4) can effectively withstand any squeezing force that could be applied unintentionally thereto.

9. A bottle and a safety closure equipped with a dropper for the bottle, comprising:

a bottle (1) having a neck (2) and a mouth with an edge;

a dropper (4) having a lower portion with an annular projection bearing on said edge of said mouth of said bottle (1);

a cap (9) enclosing said dropper and having a base with a collar (11) extending over said annular projection (5) of the dropper (4); and means for keeping said collar (11) pressed down on said annular projection and including an upper flat portion (14) of a safety strap (13) on said collar (11), said safety strap (13) further extending from said upper flat portion (14) so as to be rolled around said neck (2) of said bottle (1), both said cap (9) and said collar (11) having first engaging means (17–19) provided thereon for engagement with each other so as to ensure that said cap can be kept in place after a first utilization, said collar (11) further including second engaging means (17–19) for engagement with said safety strap (13).

10. A closure arrangement, comprising:

a dropper (4) having a lower portion with an annular projection;

a cap (9) enclosing said dropper and having a base with a collar (11) extending over said annular projection (5) of the dropper (4);

a safety strap having an upper flat portion (14); and means for keeping said collar (11) pressed down on said annular projection (5) by said upper flat portion (14) and including an upper over-turned edge (15) extending from said collar (11) and overlapping said upper flat portion (14) of said safety strap (13) so as to retain said cap (9) to said strap (13).

11. The closure arrangement as defined in claim 10; and further comprising:

means for ensuring that said cap (9) is firmly kept in place after a first utilization and including means (17–19) provided on said cap (9) and said collar (11) for engaging each other after one of said cap (9) and said collar (11) is rotated relative to the other.

12. The closure arrangement as defined in claim 11; and further comprising:

a bottle having a neck (2) with a neck shoulder (3), said dropper (4) being fitted into said neck (2), said collar (11) being formed integral with said cap (9) by junctions (12) which break apart during the first utilization, and said safety strap (13) being roller against said neck shoulder (3).

* * * * *